US009625243B1

(12) United States Patent
Haddon et al.

(10) Patent No.: US 9,625,243 B1
(45) Date of Patent: Apr. 18, 2017

(54) ELECTRONIC SETBACK VALIDATION FOR FUZES

(71) Applicant: THE UNITED STATES OF AMERICA AS REPRESENTED BY THE SECRETARY OF THE NAVY, Washington, DC (US)

(72) Inventors: Michael D. Haddon, Ridgecrest, CA (US); Paul E. Anderson, Ridgecrest, CA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 477 days.

(21) Appl. No.: 13/999,558

(22) Filed: Jun. 23, 2014

(51) Int. Cl.

| | |
|---|---|
| ***F42C 15/40*** | (2006.01) |
| ***F42C 11/02*** | (2006.01) |
| *H02J 7/34* | (2006.01) |
| *H02J 7/00* | (2006.01) |

(52) U.S. Cl.
CPC ..... *F42C 15/40* (2013.01); *F42C 11/02* (2013.01); *H02J 7/0052* (2013.01); *H02J 7/345* (2013.01)

(58) Field of Classification Search
CPC ..... F42C 11/001; F42C 11/008; F42C 11/02; F42C 15/24; F42C 15/40; F42C 15/44
USPC ..... 102/210, 231, 232, 247, 248
See application file for complete search history.

(56) References Cited

U.S. PATENT DOCUMENTS

| | | | | |
|---|---|---|---|---|
| 3,589,294 | A * | 6/1971 | Stresau | F42C 15/40 102/202.8 |
| 3,760,732 | A * | 9/1973 | Schuster | F42C 17/04 102/215 |
| 4,603,635 | A * | 8/1986 | Boudreau | F42C 15/40 102/206 |
| 7,478,595 | B1 * | 1/2009 | Herr | F42C 11/065 102/235 |
| 7,600,475 | B1 * | 10/2009 | Friedberg | F42C 9/14 102/215 |
| 7,804,223 | B1 * | 9/2010 | Teowee | F42C 9/147 310/318 |
| 2008/0072781 | A1 * | 3/2008 | Sigler | F42C 15/192 102/251 |
| 2010/0155473 | A1 * | 6/2010 | Rastegar | D21F 1/0027 235/400 |
| 2012/0291650 | A1 * | 11/2012 | Aw | F42C 1/02 102/207 |

* cited by examiner

*Primary Examiner* — Bret Hayes
(74) *Attorney, Agent, or Firm* — James M. Saunders

(57) ABSTRACT

Embodiments relate to fuze setback validation. An electronic setback validator for a launched munition safe-arm fuze includes a transient voltage suppressor. A piezoceramic element is electrically-connected to the transient voltage suppressor. A first electronic circuit is electrically-connected to the piezoceramic element and is a constant 1 milliamp discharge circuit. The first electronic circuit is configured to determine setback magnitude of acceleration. A second electronic circuit is electrically-connected to the piezoceramic element. The second electronic circuit is a constant 122 microamp charge circuit and is configured to determine setback duration of acceleration. A microcontroller is electrically-connected to the first and second electronic circuits.

18 Claims, 4 Drawing Sheets

ELECTRONIC SETBACK VALIDATION FOR FUZES

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

The invention generally relates to setback validation for fuzes.

Figure 1:
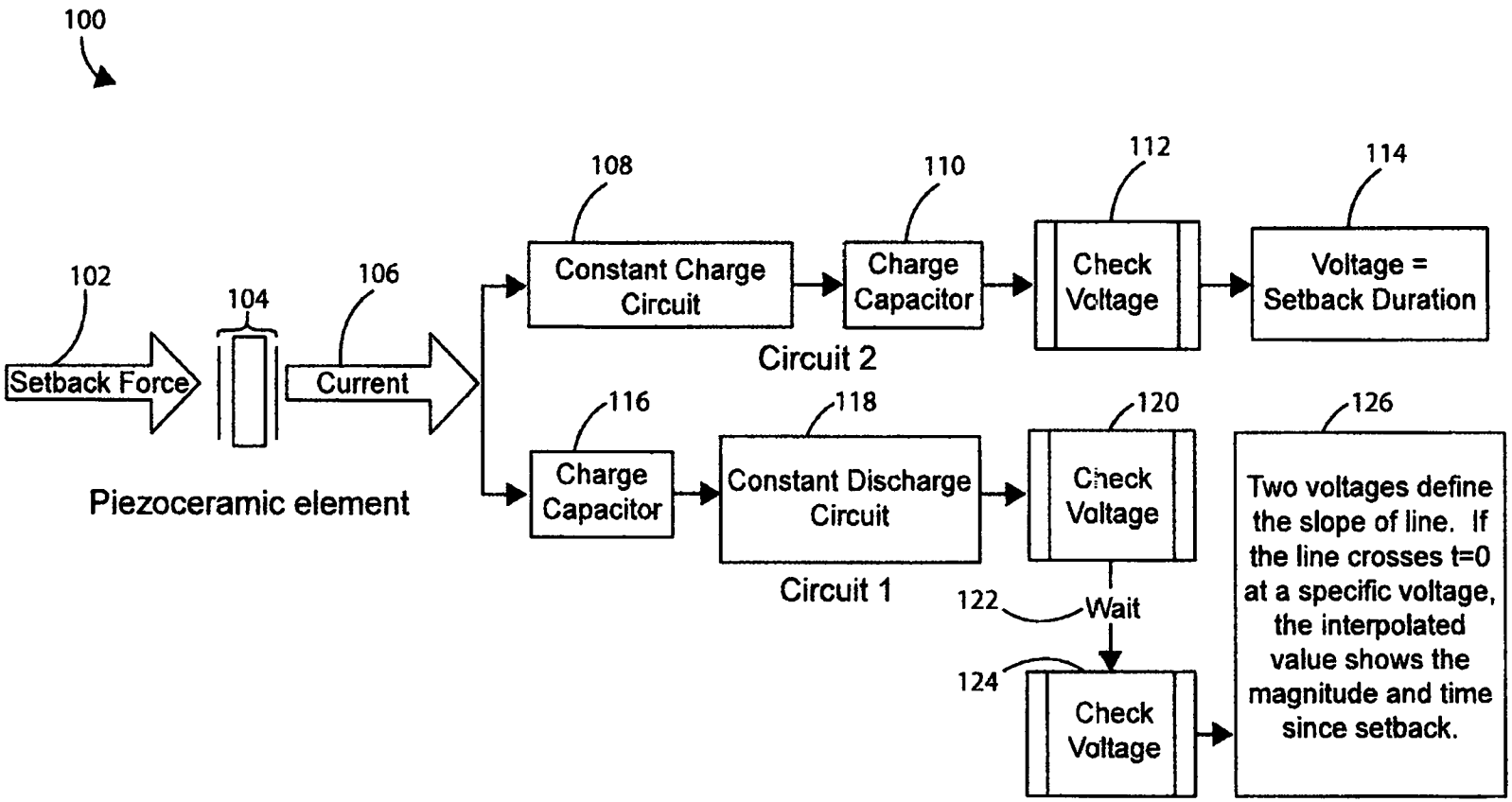
FIG. 1 is an exemplary setback validation method, according to some embodiments of the invention.

It is to be understood that the foregoing general description and the following detailed description are exemplary and explanatory only and are not to be viewed as being restrictive of the invention, as claimed. Further advantages of this invention will be apparent after a review of the following detailed description of the disclosed embodiments, which are illustrated schematically in the accompanying drawings and in the appended claims.

DETAILED DESCRIPTION OF EMBODIMENTS OF THE INVENTION

Embodiments of the invention relate to piezoelectric energy harvesting techniques. Embodiments provide solutions to shortcomings of energy being accumulated over time, from events such as repeated drops or intense vibration that would give the appearance of a setback of proper magnitude. It is, therefore, desirous, to find improved existing arming environment validation methods.

Although embodiments of the invention are described in considerable detail, including references to certain versions thereof, other versions are possible. Examples of other versions include performing the orienting electrical components in alternating sequences or hosting embodiments on different platforms. Therefore, the spirit and scope of the appended claims should not be limited to the description of versions included herein.

Conventions, Parameters, and Terminology

At the outset, it is helpful to describe various conventions, parameters, and terminology associated with embodiments of the invention.

Setback: In embodiments, setback is the force that is imparted on a piezoceramic element when a cannon (gun) fires a munition.

Piezoceramic: In embodiments, a piezoceramic element is a piezoelectric element used to generate energy. In embodiments, a piezoactuator is used as a piezogenerator, and is a 60 Volt DC, 1 microfarad component. Some examples of piezoceramic elements include, but are not limited to, quartz, topaz, barium titanate, and lead zirconate titanate. In embodiments, electrical current is generated when the setback force engages the piezoceramic element. The piezoceramic element is compressed (squeezed), causing positive pulses. Upon relaxation of the piezoceramic element, negative pulses are produced. Full-wave bridge rectifiers are used to maximize the available energy out of the piezoceramic device and to convert the pulses to DC (direct current) voltage.

Artillery rounds typically use mechanical fuzes to provide safety and arming of the explosive projectiles. Mechanical fuzes have typically been used because power is often not available within the artillery round prior to it being fired from the barrel.

Because electronic safe-arm fuzes do not receive power until after they leave the barrel, setback sensing, which is the initial acceleration experience by the projectile, is problematic. To solve this challenge, the information about the setback event can be stored until after power has been applied to the fuze. In some embodiments, the setback information is generated by a piezoelectric element and stored in capacitors.

During setback, a piezoceramic element generates current roughly proportional to the change in strain on the device. The strain on the device is proportional to the change in the acceleration. From this relationship, the current out of the circuit can be equated to the acceleration. It is important to note that the setback validation is performed without supplied power. The only setback validation power source is from the setback event.

Apparatus Embodiments

Figure 4:
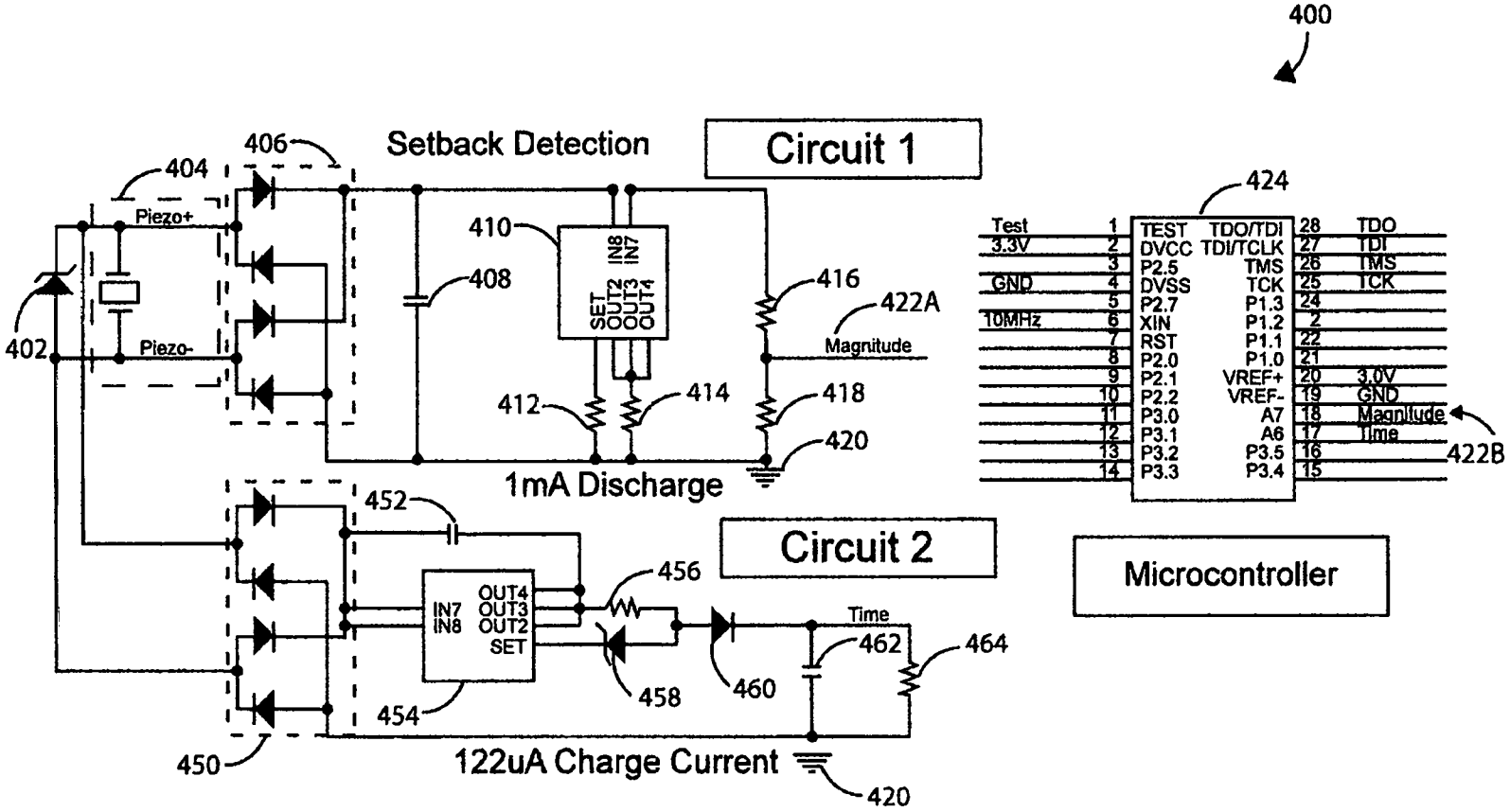
FIG. 4 is exemplary circuit diagram, according to some embodiments of the invention.

Apparatus embodiments are depicted in FIG. 4, which illustrates an exemplary circuitry diagram, and is referenced as reference character 400. Embodiments generally relate to an electronic setback validator for a launched munition safe-arm fuze, including a transient voltage suppressor 402 which steps the voltage down to less than 40 V DC to protect electronic components. An appropriate transient voltage suppressor 402 of less than or equal to 39 V DC is suitable. A piezoceramic element 404 is electrically-connected to the transient voltage suppressor 402. A first electronic circuit (406 through 422A) is electrically-connected to the piezoceramic element 404. The first electronic circuit (406 through 422A) is a constant 1 miliamp discharge circuit, and is configured to determine setback magnitude of acceleration associated with a launched munition.

A second electronic circuit (450 through 464) is electrically-connected to the piezoceramic element 404. The second electronic circuit (450 through 464) is a constant 122 microamp charge circuit and is configured to determine setback duration of acceleration associated with the launched munition. A microcontroller 424 is electrically-connected to the first (406 through 422A) and second electronic circuits (450 through 464).

The first electronic circuit (406 through 422A) has a full-wave bridge rectifier 406. A discharge capacitor 408 is electrically-connected in parallel with the bridge rectifier 406. The discharge capacitor 408 discharges about 1 milliamps. A precision current source 410 is electrically-connected in parallel with the discharge capacitor 408. The precision current source 410 has an input and output. The precision current source 410 is a computer chip configured to regulate current at a constant current in the first electronic circuit (406 through 422A).

First and second precision current source output resistors (412 & 414) are electrically-connected to the precision current source 410 output. The first and second precision current source output resistors (412 & 414) are connected parallel with each other and have resistances of about 10 kiliohms and 100 ohms, respectively. A first setback magnitude resistor 416 has a resistance of about 1 megaohm. The first setback magnitude resistor 416 is electrically-connected in parallel with the precision current source 410.

A second setback magnitude resistor 418 has a resistance range of about 200 lciliohms to about 2 megaohms and is electrically-connected in parallel with the precision current source 410. A setback magnitude junction 422A is electrically-connected between the first and second setback magnitude resistors 416 & 418. The setback magnitude junction 422A is in electrical communication with the microcontroller 424.

The discharge capacitor 408 has a capacitance range of about 0.47 microfarads to about 10 microfarads, depending on application-specific conditions. Thus, for example, the discharge capacitor may have capacitance values of 0.47, 1, or 10 microfarads.

The second electronic circuit (450 through 464) has a full-wave bridge rectifier 450. A current stabilization capacitor 452 has a capacitance of 1000 picofarads and voltage of 100 V DC and is electrically-connected in series with the full-wave bridge rectifier 450. A precision current source 454 has an input and an output, with the input being electrically-connected with the full-wave bridge rectifier 450 and the output being electrically-connected with the current stabilization capacitor 452. The precision current source 454 is a computer chip configured to regulate current at a constant current in the second electronic circuit (450 through 464). The precision current sources 410 and 454 in the first (406 through 422A) and second (450 through 464) electronic circuits, respectively, are rated at 40 V DC.

A precision current source output resistor 456 is electrically-connected to the precision current source 454 output. A 1.2 volt precision voltage reference 458 is electrically-connected to the precision current source 454. A charge diode 460 is positioned between and electrically-connected at a junction located between the precision current source output resistor 456 and the precision voltage reference 458. A charge capacitor 462 is electrically-connected in series with the charge diode 460. A 10 megaohm resistor 464 is electrically-connected in parallel with the charge capacitor 462.

The precision current source output resistor 456 has a resistance of about 10 kiliohoms. The charge capacitor 462 has a capacitance range of about 0.1 microfarads to about 4.7 microfarads. The piezoceramic element 404 provides about 60 V DC voltage to the first (406 through 422A) and second (450 through 464) electronic circuits. Examples for the piezoceramic element 404 includes quartz and oscillators.

The microcontroller 424 is configured to measure voltages in the first (406 through 422A) and second (450 through 464) electronic circuits. The microcontroller 424 has built in logic for analog to digital conversion and vice versa. The microcontroller's 424 analog-to-digital converter measures the voltages at two nodes: the "Magnitude" node 422A in the discharge capacitor 408 and the "Time" node (positioned between reference characters (462 & 464) in the charge capacitor 462.

The microcontroller 424 compares the voltages measured against the values stored in lookup tables to validate the setback environment. When the setback environment is validated, the fuze progresses in the arming process.

Method Embodiments

FIG. 1 illustrates a method for setback validation in fuses, according to some embodiments, and is depicted as reference character 100. Another embodiment of the invention includes a method for setback validation in fuzes. The method includes providing a munition. Examples for the munition include, but are not limited to munitions out of cannons and guns. The munition is launched, which generates a setback force. The setback force is applied from the launched munition to a piezoceramic element, which causes the piezoceramic element to generate a constant setback current (tasks 102, 104, & 106).

A first electronic circuit, having a discharge capacitor, is provided and electrically-connected to the piezoceramic element (tasks 116 & 118). A second electronic circuit, having a charge capacitor, is provided and electrically-connected to the piezoceramic element. (tasks 108 & 110) A microcontroller is provided and is in electrical communication with both the first and second electronic circuits (tasks 112 through 126). The first and second electronic circuits work together to validate the setback environment.

The first electronic circuit is charged with the constant setback current and the discharge capacitor is discharged (tasks 116 & 118). Because of how the piezoceramic element functions, this makes the voltage on the capacitor a function of the magnitude of the setback. The capacitor is then discharged with a known constant current. By looking at the voltage across the capacitor, with the known discharge rate, the time since the setback can be calculated.

The second electronic circuit is charged with the constant setback current and the charge capacitor is charged (tasks 108 & 110). The second circuit charges the capacitor with a known constant current generated during the setback. By measuring the voltage on this second capacitor some time after the setback event, one can use the known charge rate to calculate the duration of the setback.

A person having ordinary skill in the art will recognize that munitions (weapons) use thermal batteries to activate their associated fuzes. In the first electronic circuit, sometime after setback, the munition's (weapon's) thermal battery is activated which causes the safe-arm fuze to come out of reset and begin checking the setback conditions. The safe-arm fuze is powered. The voltage of the discharge capacitor is measured a first time at power-up of the munition (task 120). Power-up of the munition occurs when the munition's thermal battery is powered up. The voltage of the charge capacitor is measured once after the constant setback current is generated (task 112).

The voltage of the discharge capacitor is then measured a second time, about 30 milliseconds (depicted as reference character 122 "wait") after the first voltage measurement of the discharge capacitor (task 124). The discharge capacitor is discharged at a constant rate such that the associated voltage decay on the discharge capacitor is linear with respect to time and defined as $$\frac{I}{C} = \frac{dV}{dt}.$$

Figure 2:
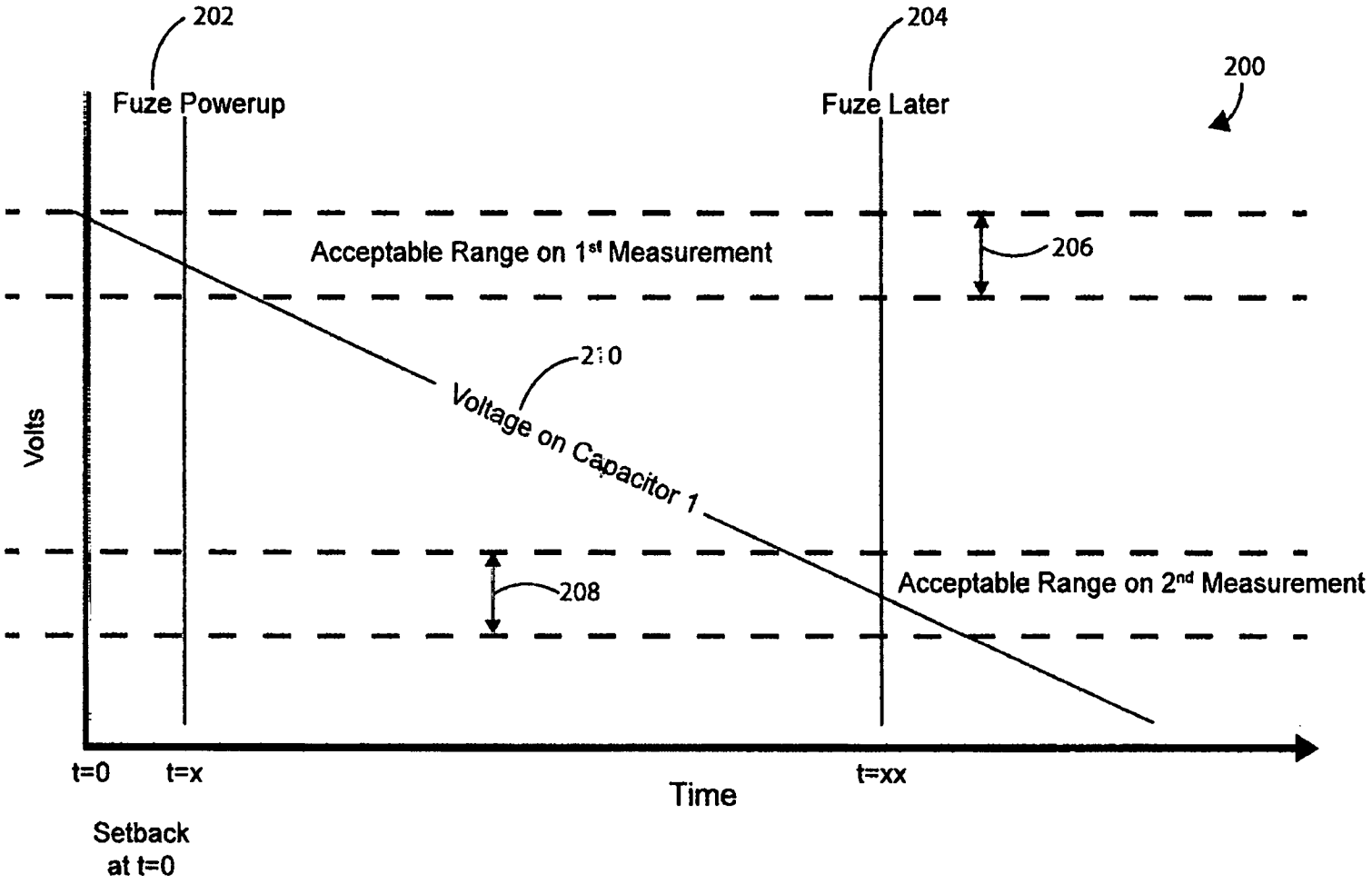
FIG. 2 is an exemplary graph depicting setback magnitude determination, according to some embodiments of the invention.

Referring to FIG. 2, which depicts setback magnitude determination, depicted generically as reference character 200, a slope of the line (reference character 210) depicting the voltage of the discharge capacitor is determined and a setback magnitude is interpolated between the first and second measurements 202 & 204 of the discharge capacitor. Reference character 202 depicts the first measurement at power-up and reference character 204 depicts the second measurement, about 30 milliseconds later. Reference character 206 depicts an acceptable voltage range for the first measurement and reference character 208 depicts an acceptable voltage range for the second measurement.

The first and second measurements 202 & 204 of the discharge capacitor voltage define a first and second fixed voltage threshold, coinciding with the acceptable voltage ranges for the first 206 and second 208 measurements, respectively. The first fixed voltage threshold 206 has a range of about 30 volts DC to about 40 volts DC, based on application-specific conditions. The second fixed voltage threshold 208 has a range of about 10 volts DC to about 20 volts DC, based on application-specific conditions. A person having ordinary skill in the art will recognize that the application-specific conditions include, but are not limited to, the particular type of cannon/gun being used as well as the particular munition. When the slope of the line 210 depicting the voltage of the discharge capacitor crosses the y-intercept at time t=0, the interpolated value graphically depicts the setback magnitude and time since the setback event of the discharge capacitor (tasks 122, 124, & 126).

By using the slope of the line 210 created, it is possible to look back in time to interpolate a setback magnitude. Because there is an expected magnitude of setback, as well as the time since setback, an appropriate magnitude can be verified by using fixed voltage thresholds. The stack-up of component tolerances are included in the voltage thresholds.

Figure 3:
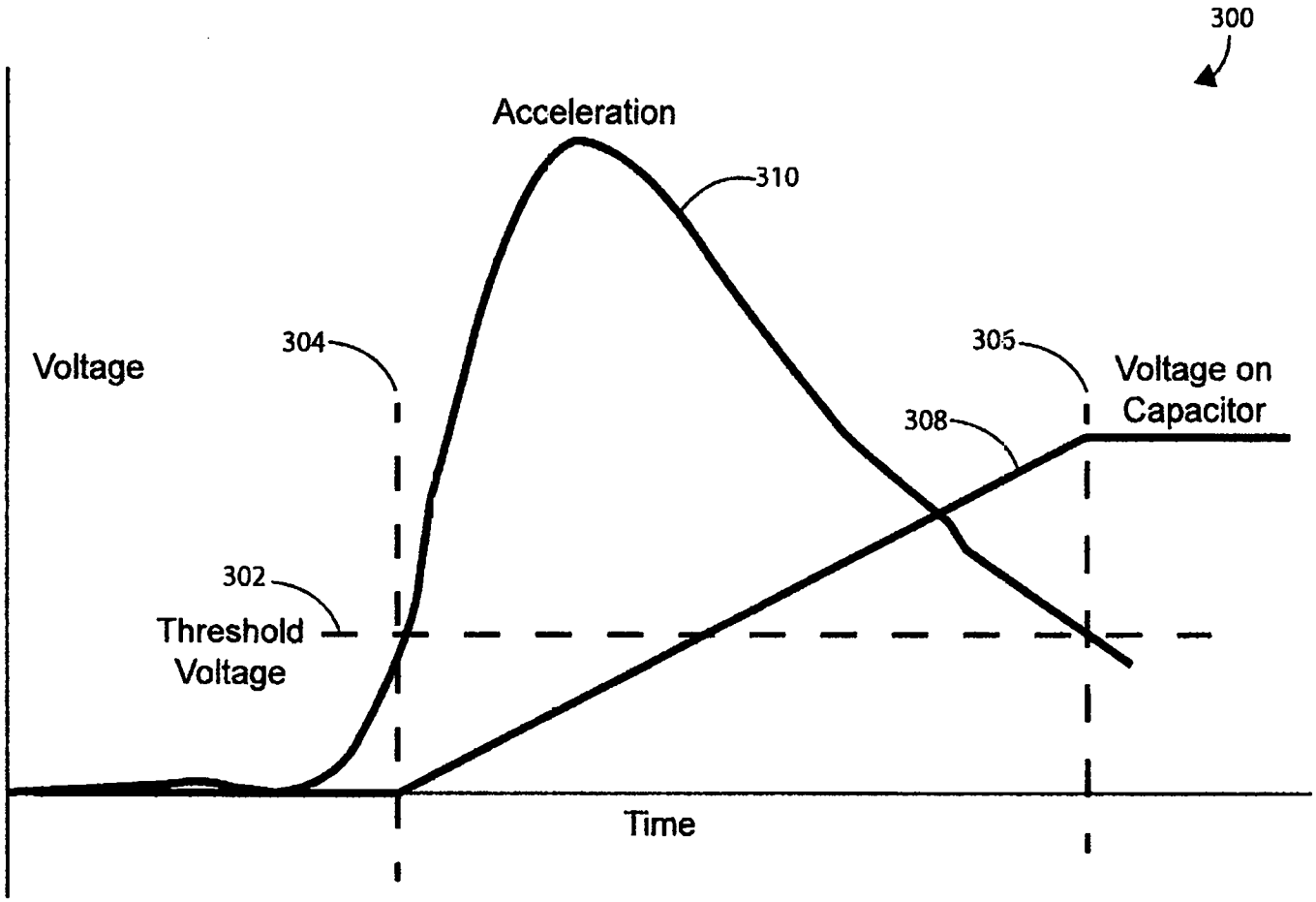
FIG. 3 is an exemplary graph depicting the determination of duration of the setback event, according to some embodiments of the invention.

FIG. 3 illustrates the determination of the duration of the setback event, depicted as reference character 300. When the measurement voltage of the charge capacitor exceeds a threshold (reference character 302) voltage, the charge capacitor is charged such that the setback duration, dt, of the charge capacitor is determined. The threshold 302 is a range of greater than 0 V DC to less than or equal to 5 V DC. The setback duration is proportional to voltage and defined as $$dt = dv\frac{C}{I}$$

(task 114). Reference character 308 depicts the voltage on the charge capacitor between two points in time (reference characters 304 & 306). The two points in time 304 & 306 define the period during which current is flowing into the charge capacitor. The voltage on the duration capacitor is read at fuze power-up and compared to a range of acceptable values specific to the setback profile. Stack-up of component tolerances are included in the voltage thresholds. Curve 310 depicts the acceleration of the munition. The accumulation of voltage of the charge capacitor is roughly proportional to the time spent under the curve 310 (duration of the setback event).

The microcontroller is instructed to determine whether the setback profile is within an acceptable range. The setback profile is defined by the magnitude and duration of setback forces. When either the duration or magnitude calculations are incorrect, the fuze is instructed to enter a safe mode. The associated figures depicting the process (FIGS. 1, 2, & 3) are graphical illustrations of part of the process which the microcontroller is instructed to perform.

An "incorrect" state refers to when the measurements fall outside the acceptable ranges, causing the fuze to enter a safe mode. Thus, the duration or magnitude calculations are considered "incorrect" when the first fixed voltage threshold 206 is not within the range of about 30 V DC to about 40 V DC. Likewise, the duration or magnitude calculations are considered "incorrect" when the second fixed voltage threshold 208 is not within the range of about 10 V DC to about 20 V DC. Similarly, the duration or magnitude calculations are considered "incorrect" when the measurement voltage of the charge capacitor does not exceed the threshold 302 of greater than 0 V DC to less than or equal to 5 V DC. The deduction is that measurements falling outside the acceptable ranges are the result of a munition that was not fired (such as a squib load) or a dropped munition.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. An electronic setback validator for a launched munition safe-arm fuze, comprising:

a transient voltage suppressor;

a piezoceramic element electrically-connected to said transient voltage suppressor;

a first electronic circuit electrically-connected to said piezoceramic element, said first electronic circuit is a constant 1 miliamp discharge circuit, said first electronic circuit configured to determine setback magnitude of acceleration;

a second electronic circuit electrically-connected to said piezoceramic element, said second electronic circuit is a constant 122 microamps charge circuit, said second electronic circuit configured to determine setback duration of acceleration; and a microcontroller electrically-connected to each of said first electronic circuit and said second electronic circuit.

2. The validator according to claim 1, said first electronic circuit, comprising:

a full-wave bridge rectifier;

a discharge capacitor electrically-connected in parallel with said bridge rectifier, said discharge capacitor discharging about 1 milliamps;

a precision current source electrically-connected in parallel with said discharge capacitor, said precision current source having an input and output, said precision current source is a computer chip configured to regulate current at a constant current in said first electronic circuit;

first and second precision current source output resistors electrically-connected to said precision current source output, wherein said first and second precision current source output resistors are in parallel with each other, said first and second precision current source output resistors having resistances of about 10 kiliohms and 100 ohms respectively;

a first setback magnitude resistor having a resistance of about 1 megaohm, said first setback magnitude resistor electrically-connected in parallel with said precision current source;

a second setback magnitude resistor having a resistance range of about 200 kiliohms to about 2 megaohms, said second setback magnitude resistor electrically-connected in parallel with said precision current source; and a setback magnitude junction electrically-connected between said first and second setback magnitude resistors, said setback magnitude junction in electrical communication with said microcontroller.

3. The validator according to claim 2, wherein said discharge capacitor has a capacitance range of about 0.47 microfarads to about 10 microfarads.

4. The validator according to claim 1, said second electronic circuit, comprising:

a full-wave bridge rectifier;

a current stabilization capacitor having a capacitance of 1000 picofarads, said current stabilization capacitor is electrically-connected in series with said full-wave bridge rectifier;

a precision current source having an input and an output, said input electrically-connected with said full-wave bridge rectifier, said output electrically connected with said current stabilization capacitor, said precision current source is a computer chip configured to regulate current at a constant current in said second electronic circuit;

a precision current source output resistor electrically-connected to said precision current source output;

a 1.2 volt precision voltage reference electrically-connected to said precision current source;

a charge diode electrically-connected at a junction located between said precision current source output resistor and said precision voltage reference;

a charge capacitor electrically-connected in series with said charge diode; and a 10 megaohm resistor electrically-connected in parallel with said charge capacitor.

5. The circuit according to claim 4, wherein said precision current source output resistor has a resistance of about 10 kiliohms.

6. The circuit according to claim 4, wherein said charge capacitor is about 0.1 to 4.7 microfarads.

7. The circuit according to claim 1, wherein said piezoceramic element provides 60 V DC voltage to said first and second electronic circuits, and has a capacitance of about 1 microfarad.

8. The circuit according to claim 1, said microcontroller configured to measure voltages in said first and said second electronic circuits.

9. A method for setback validation in fuzes, comprising:

providing a munition having a safe-arm fuze;

launching said munition, said launched generating a setback force;

applying said setback force from said launched munition to a piezoceramic element, causing said piezoceramic element to generate a constant setback current;

providing a first electronic circuit electrically-connected to said piezoceramic element, said first electronic circuit having a discharge capacitor;

providing a second electronic circuit electrically-connected to said piezoceramic element, said second electronic circuit having a charge capacitor;

providing a microcontroller in electrical communication with said first electronic circuit and said second electronic circuit;

charging said first electronic circuit with said constant setback current;

discharging said discharge capacitor;

charging said second electronic circuit with said constant setback current;

charging said charge capacitor;

measuring the voltage of said discharge capacitor a first time at power-up of said munition;

measuring the voltage of said charge capacitor once after said constant setback current is generated;

measuring the voltage of said discharge capacitor a second time, about 30 milliseconds after said first measurement, wherein said discharge capacitor is discharged at a constant rate, the associated voltage decay on said discharge capacitor is linear with respect to time and defined as $$\frac{I}{C} = \frac{dV}{dt},$$

wherein a slope of the line depicting the voltage of said discharge capacitor is determined and a setback magnitude interpolated between said first and second measurements of said discharge capacitor, said first and second measurements defining a first and second fixed voltage thresholds, said first fixed voltage threshold having a range of about 30 V DC to about 40 V DC, said second fixed voltage threshold having a range of about 10 V DC to about 20 V DC, wherein when the slope of the line depicting the voltage of said discharge capacitor crosses the y-intercept at time t=0, the interpolated value graphically depicts the setback magnitude and time since said setback event of said discharge capacitor;

wherein when the measurement voltage of said charge capacitor exceeds a threshold of greater than 0 V DC to less than or equal to 5 V DC, said charge capacitor is charged such that the setback duration, dt, of said charge capacitor is determined, wherein said setback duration is proportional to voltage and defined as $$dt = dv\frac{C}{I}.$$

10. The method according to claim 9, said microcontroller determines whether the setback profile is within an acceptable range, said setback profile is defined by the magnitude and duration of setback forces, wherein said acceptable range of the setback profile is equivalent to said first fixed voltage threshold, said second fixed voltage threshold, and the measurement voltage of said charge capacitor threshold.

11. The method according to claim 10, wherein when either the duration or magnitude calculations are incorrect, said fuze is instructed to enter a safe mode, wherein the duration or magnitude calculations are defined as incorrect when: said first fixed voltage threshold is not within the range of about 30 V DC to about 40 V DC; or said second fixed voltage threshold is not within the range of about 10 V DC to about 20 V DC; or the measurement voltage of said charge capacitor does not exceed the threshold of about greater than 0 V DC to about less than or equal to 5 V DC.

12. The method according to claim 9, further comprising providing an electronic setback validator for launched munition safe-arm fuze, said electronic setback validator, comprising:

a transient voltage suppressor;

said piezoceramic element electrically-connected to said transient voltage suppressor;

said first electronic circuit electrically-connected to said piezoceramic element, said first electronic circuit is a constant 1 miliamp discharge circuit, said first electronic circuit configured to determine setback magnitude of acceleration; and said second electronic circuit electrically-connected to said piezoceramic element, said second electronic circuit is a constant 122 microamp charge circuit, said second electronic circuit configured to determine setback duration of acceleration.

13. The method according to claim 12, said first electronic circuit comprising:

a full-wave bridge rectifier;

said discharge capacitor electrically-connected in parallel with said bridge rectifier, said discharge capacitor discharging about 1 milliamps;

a precision current source electrically-connected in parallel with said discharge capacitor, said precision current source having an input and output, said precision current source is a computer chip configured to regulate current at a constant current in said first electronic circuit;

first and second precision current source output resistors electrically-connected to said precision current source output, wherein said first and second precision current source output resistors are in parallel with each other, said first and second precision current source output resistors having resistances of about 10 kiliohms and 100 ohms respectively;

a first setback magnitude resistor having a resistance of about 1 megaohm, said first setback magnitude resistor electrically-connected in parallel with said precision current source;

a second setback magnitude resistor having a resistance range of about 200 kiliohms to about 2 megaohms, said second setback magnitude resistor electrically-connected in parallel with said precision current source; and a setback magnitude junction electrically-connected between said first and second setback magnitude resistors, said setback magnitude junction in electrical communication with said microcontroller.

14. The method according to claim 13, wherein said discharge capacitor has a capacitance range of about 0.47 microfarads to about 10 microfarads.

15. The method according to claim 12, said second electronic circuit, comprising:

a full-wave bridge rectifier;

a current stabilization capacitor having a capacitance of 1000 picofarads, said current stabilization capacitor is electrically-connected in series with said full-wave bridge rectifier;

a precision current source having an input and an output, said input electrically-connected with said full-wave bridge rectifier, said output electrically-connected with said current stabilization capacitor, said precision current source is a computer chip configured to regulate current at a constant current in said second electronic circuit;

a precision current source output resistor electrically-connected to said precision current source output;

a 1.2 volt precision voltage reference electrically-connected to said precision current source;

a charge diode electrically-connected at a junction located between said precision current source output resistor and said precision voltage reference;

said charge capacitor electrically-connected in series with said charge diode; and a 10 megaohm resistor electrically-connected in parallel with said charge capacitor.

16. The method according to claim 15, wherein said precision current source output resistor has a resistance of about 10 kiliohms.

17. The method according to claim 15, wherein said charge capacitor is about 0.1 to 4.7 microfarads.

18. The method according to claim 9, wherein said piezoceramic element provides 60 V DC voltage to said first and said second electronic circuits, and has a capacitance of about 1 microfarad.

* * * * *